US005892423A

United States Patent [19]

Haas et al.

[11] Patent Number: 5,892,423

[45] Date of Patent: Apr. 6, 1999

[54] ELECTRIC SWITCHING DEVICE AND METHOD OF MAKING A MAGNETIC ANGLE PIECE FOR SAME

[75] Inventors: Lothar Haas, Rosstal; Joachim Naser, Nuremberg; Hans Schrumpf, Oberasbach; Sonja Reitenspiess, Nuremberg, all of Germany

[73] Assignee: Robert Bosch GmbH, Stuttgart, Germany

[21] Appl. No.: 10,068

[22] Filed: Jan. 21, 1998

[30] Foreign Application Priority Data

Jan. 25, 1997 [DE] Germany ..... 197 02 717.2

[51] Int. Cl.[6] ..... H01H 67/02

[52] U.S. Cl. ..... 335/128; 335/281

[58] Field of Search ..... 335/78–86, 124, 335/128, 249, 250, 252, 253, 258, 270, 275, 276, 281, 251

[56] References Cited

U.S. PATENT DOCUMENTS

| | | | |
|---|---|---|---|
| 4,101,855 | 7/1978 | Drapeau | 335/128 |
| 4,684,909 | 8/1987 | Dittmann | 335/128 |
| 4,924,197 | 5/1990 | Siepmann | 335/128 |

FOREIGN PATENT DOCUMENTS 44 11879 A1 10/1995 Germany .

*Primary Examiner*—Lincoln Donovan
*Attorney, Agent, or Firm*—Michael J. Striker

[57] ABSTRACT

The electrical switching apparatus includes a housing (10), a coil (20) arranged in the housing (10), at least two switch terminals (35,50,60) arranged in the housing (10), a magnetic angle piece (30) in the housing (10) including a core (32) for the coil (20) and an armature (42) resiliently mounted on the magnetic angle piece (30) for making electrical contact between two switch terminals (35,50,60). The magnetic angle piece is preferably made by a method including punching or stamping a nearly rectangular piece (39) from sheet metal, forming a U-shaped opening around a separately bendable tongue (32*a*) in a central region of the nearly rectangular piece (39) so that side pieces (30*a*) are formed on opposite sides of the U-shaped opening (38) and a connecting piece (31*a*) connects the side pieces (30*a*) on another end of the rectangular piece (39) opposite from one switch terminal; bending the separately bendable tongue (32*a*) at right angles to a remaining portion of the nearly rectangular piece (39) including the side pieces (30*a*) to form the core (32) of the coil (20) and bending the connecting piece (31*a*) at substantially right angles to form an upper portion (31) of the magnetic angle piece arranged substantially parallel to the core (32).

7 Claims, 2 Drawing Sheets

35
38
32a
39
30a
40
40
31a
30a 35
32
30
40
31
40

ELECTRIC SWITCHING DEVICE AND METHOD OF MAKING A MAGNETIC ANGLE PIECE FOR SAME

BACKGROUND OF THE INVENTION

The present invention relates to an electrical switching device, especially to an electrical relay, and, more particularly, to an electrical switching device comprising a housing, a coil having a coil core, a magnetic angle piece arranged in the housing and carrying the coil core, at least two switch terminals arranged in the housing, one of which being connected with the magnetic angle piece, and an armature arranged resiliently on the magnetic angle piece, by whose operation a contact is made between the at least two switch terminals.

This type of electrical switching device is, for example, based on the device described in German Patent DE 44 11 879 A1. The magnetic angle piece and the core of the coil are formed as one angular piece in this switching device and the magnetic angle piece has a right angle bend. The coil core is arranged similarly parallel to an upper section of the magnetic angle piece so that it extends parallel to the upper portion of the magnetic angle piece. A space or distance which approximately equals half the coil diameter is provided between the core of the coil and the upper portion of the magnetic angle piece which operates as retainer for the coil and as magnetic connection element. A switch terminal is attached to the magnetic angle piece.

This sort of structure of the magnetic angle piece and the core, in which comparatively large cavities are provided between the core and magnetic angle piece parts, leads to a considerable material loss in manufacture, since material which was located in the recesses or cavities between the magnetic angle piece parts and the core is wasted.

Moreover an additional attachment of the switch terminal to the magnetic angular part and thus an additional manufacturing step is required with a magnetic angle piece of this type.

SUMMARY OF THE INVENTION

It is an object of the present invention to provide an improved electrical switching device of the above-described type, especially an electrical relay, and which can be made in a simple way and with as little material usage as possible, i.e. with reduced material loss.

According to the invention, in an electrical switching device, especially an electrical relay, of the above-described type the magnetic angle piece includes the core and at least one switch terminal in a one-piece bent punched or stamped piece in which the core is formed by bending a separately bendable tongue formed in the unbent punched or stamped piece away or out from a remaining portion of an unbent advantageously rectangular punched or stamped piece.

The formation of the magnetic angle piece with the core and the at least one switch terminal as a one-piece punched part has the great advantage that both the magnetic angular part, the core of the coil and the switch terminal can be made by only one single punching process. In this way an additional attachment of the switch terminal/terminals and/or the magnetic core to the magnetic angle piece is eliminated.

It is particularly advantageous that the core is formed in an unbent state in the punched or stamped piece as a separately bendable tongue in the magnetic angle piece because only a comparatively reduced material usage is required, i.e. there are only reduced material losses during making of the core.

Theoretically the punched part for formation of the magnetic angle piece with the core and the switch terminal can have any arbitrary shape or form. The tongue in the magnetic angle piece can similarly be formed in the most widely varying ways.

Especially in order to provide a simple and rapid manufacture of the magnetic angle piece and the core of the coil as well as the switch terminal attached to the magnetic angle piece, in a preferred embodiment the punched or stamped piece has a substantially rectangular shape or form. The one switch terminal is formed on one side of the punched or stamped piece. It is provided with a central U-shaped opening which is only, e.g., made by cutting out from the punched or stamped piece to form the tongue which is bendable to form the core and a remaining portion of the punched or stamped piece including a connecting piece which is also bendable to form an upper portion of the magnetic angle piece parallel to the core.

Because of the particularly advantageous mass production of the punched or stamped piece, an especially rapid manufacture and, as a result of that, also economical manufacture, of the magnetic angle piece, of the core attached to the magnetic angle piece and of the switch terminal on the magnetic angle piece is possible.

In order to guarantee a simple attachment of the armature to the magnetic angle piece, a leaf spring for positioning the armature and rivet pins attaching the leaf spring to side pieces of the unbent punched or stamped part are provided so that the leaf spring is attached to the magnetic angle piece by means of a rivet connection.

The method of making a magnetic angle piece for the electrical switching device, especially an electrical relay, includes punching or stamping a substantially rectangular punched or stamped piece from sheet metal including a switch terminal on one end of it in one piece with the punched or stamped piece; providing a U-shaped opening for formation of a separately bendable tongue in a central region of the punched or stamped piece so that side pieces are located on opposite sides of the U-shaped opening and a connecting piece connects the side pieces on another end of the punched or stamped piece opposite to the at least one switch terminal; bending the tongue at substantially right angles to a remaining portion of the substantially rectangular punched or stamped piece including the side pieces to form the core and bending the rectangular connecting piece at substantially right angles to the remaining portion of the substantially rectangular punched or stamped piece including the side pieces to form an upper portion of the magnetic angle piece arranged substantially parallel to the core.

In a most preferred embodiment of the invention the tongue is cut out directly from the punched or stamped piece and the core is immediately formed by subsequently bending the tongue. In this way the U-shaped opening can be reduced or substantially eliminated, whereby a further reduction of material loss is avoided.

Preferably a space or distance between an upper portion of the magnetic angular piece and the core arises which is substantially equal to half a diameter of the coil. The coil on the magnetic angle piece can be exactly position and attached in this way.

BRIEF DESCRIPTION OF THE DRAWING

The objects, features and advantages of the invention are described in further detail in the following detailed description with reference to the accompanying drawing, in which.

DESCRIPTION OF THE PREFERRED EMBODIMENT

Figure 1:
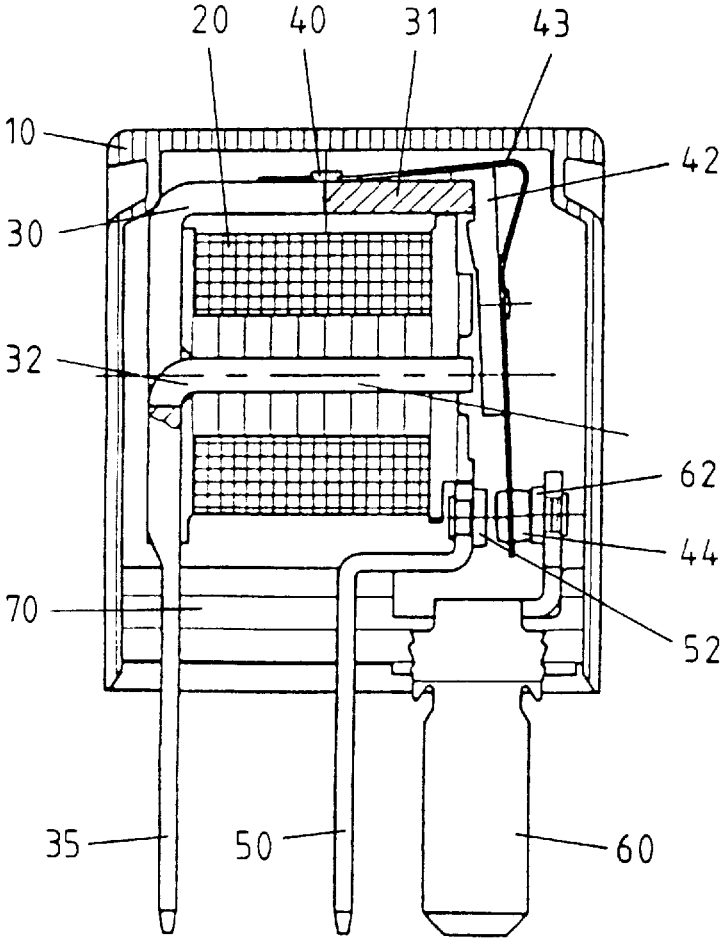
FIG. 1 is a schematic partially cross-sectional view through an electrical switching device according to the invention.

An embodiment of an electrical switching device in the form of a micro-relay is shown in FIG. 1 including a housing indicated with the reference number 10 as a whole. A magnetic angle piece 30 supporting a coil 20 is arranged in the housing 10. A core 32 of the coil 20 is mounted or arranged on the magnetic angle piece 30.

The spacing between the core 32 and an upper portion 31 of the magnetic angle piece 30, which operates, among other things, also as a magnetic terminal element, is selected so that it corresponds to substantially half the diameter of the coil 20. An armature 42 is attached by a rivet connection 40 to the upper portion 31 of the magnetic angle piece 30. The armature is resiliently mounted by means of a leaf spring 43 and is pulled magnetically to the coil 20 when a current passes through it, whereby a contact element 44 attached to a lower region of the leaf spring 43 makes contact with another contact element 52, which is electrically connected with another switch terminal 50.

The contact element 44 of the armature makes contact with an additional contact element 62 of an additional switch terminal 60 when the armature is not pulled or drawn magnetically toward the coil 20. This type of micro-relay operates as a switching relay. The present invention is not limited to a switching relay. Understandably also other relay types can be formed in the above-described manner.

A switch terminal 35 is part of the magnetic angle piece 30 in its lower region. This switch terminal 35, the switch terminal 50 and the switch terminal 60 are embedded, for example, in a casting compound 70 in a lower part of the housing.

As shown in FIG. 1, the magnetic angle piece 30 is formed as a single piece with its upper magnetic angle piece 31, the core 32 and the switch terminal 35.

Figure 2:
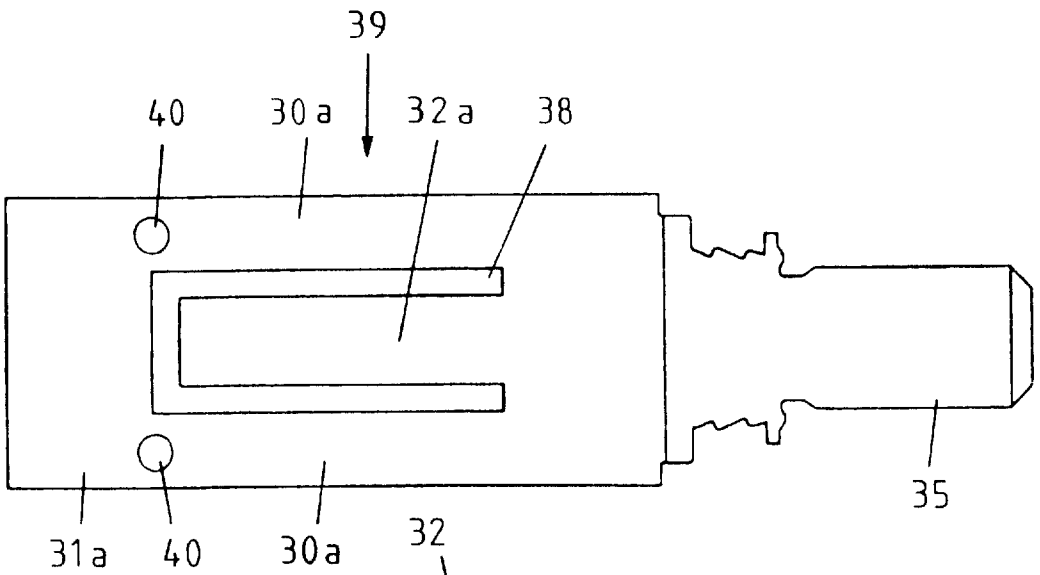
FIG. 2 is a diagrammatic plan view of a nearly rectangular punched or stamped piece for forming a magnetic angle piece with the core of the coil and a switch terminal of the switching device according to the invention, in an unbent state.
Figure 3:
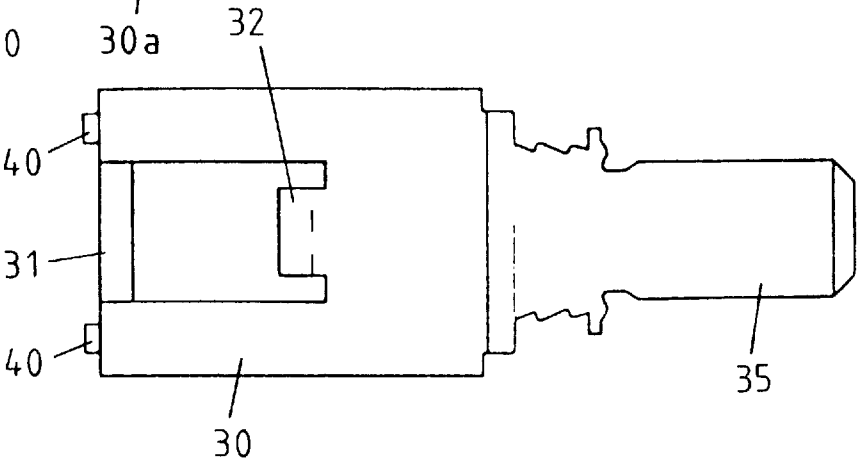
FIG. 3 is a diagrammatic plan view of the punched or stamped piece of FIG. 2 in a bent state.

An example of the manufacture of these parts is described with the aid of FIGS. 2 and 3.

As seen from FIG. 2, a substantially rectangular piece 39 is punched or stamped out first from sheet metal. A switch terminal 35 is formed in one piece with this rectangular punched or stamped piece 39 on one end of it.

A very small U-shaped opening 38 for formation of a similarly rectangular tongue 32*a* is formed substantially in the middle of the punched or stamped rectangular piece 39.

This tongue 32*a* is surrounded by the remainder of the rectangular piece 39, which includes two side pieces 30*a* arranged substantially parallel to the tongue 32*a* on opposite sides of it and a rectangular connecting member 31*a* connecting both these side pieces 30*a*.

Then both the tongue 32*a* for the core 32 and also the rectangular connecting member 31*a* connected to the side pieces 30 around the tongue 32*a* for the upper portion 31 of the magnetic angle piece 30 are bent to form the magnetic angle piece 30 with its upper portion 31 and the core 32.

The bending of the tongue 32*a* and the partial bending of the rectangular connecting member 31*a* and the side pieces 30 surrounding the tongue for the core 32 and the upper portion 31 of the magnetic angle piece is clearly illustrated in FIG. 3.

The direction of the bending of the tongue 32*a* and the rectangular connecting member 31*a* arranged on the side pieces 30*a* is into the plane of the paper in the part illustrated in FIG. 3. As can be seen from FIG. 3, the magnetic angle piece 30 is manufactured in a simple and rapid manner by the simultaneous bending of the tongue 32*a* and the upper portion 31 of the magnetic angle piece. The bending of the side pieces 30*a* occurs at a place so that the rivet pins 40 are attached at a position which allows a precise attachment of the armature 42 by means of the leaf spring 43 via a rivet connection.

Another embodiment of the manufacturing process provides that the tongue 32*a* is directly cut out or sheared out of the rectangular piece 39 and the bending of the core 32 out from it occurs immediately after that. The very small U-shaped opening can be reduced to a minimum in this way whereby a further reduction of the material loss results.

The formation of the magnetic angle piece 30 and the core 32 by a punched piece with the tongue 32*a* arranged in the punched piece permits not only a rapid and trouble-free, but also a particularly material-saving, manufacture of the magnetic angle piece with the core 32 and the switch terminal 25. The very small material loss is substantially determined by the complement of the switch terminal 35 and the U-shaped opening.

The disclosure in German Patent Application 197 02 717.2 of Jan. 25, 1997 is incorporated here by reference. This German Patent Application describes the invention described hereinabove and claimed in the claims appended hereininbelow and provides the basis for a claim of priority for the instant invention under 35 U.S.C. 119.

While the invention has been illustrated and described as embodied in an electrical switching device and method of making a magnetic angle piece for same, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

We claim:

1. An electrical switching apparatus comprising:

a housing (10);

a coil (20) arranged in the housing (10);

at least two switch terminals (35,50,60) arranged in the housing (10);

a magnetic angle piece (30) arranged in the housing (10) and including two side pieces (30*a*), one (35) of said at least two switch terminals (35,50,60) connected to the two side pieces (30*a*) at one end of the magnetic angle piece, an upper portion (31) of the magnetic angle piece extending at substantially right angles to the two side pieces (30*a*) and connecting the side pieces (30*a*) at another end of the magnetic angle piece opposite from the one end and a core (32) for the coil (20), the core (32) extending at substantially right angles to the side pieces (30*a*) between the two side pieces (30*a*), wherein said upper portion (31), said two sides pieces (30*a*), said core (32) and said one (35) of said at least two switch terminals (35,50,60) are all in one piece in said magnetic angle piece; and an armature (42) resiliently mounted on the magnetic angle piece (30) for making electrical contact between said one (35) of at least two switch terminals (35,50,60) and another of said at least two switch terminals (35,50,60).

2. The electrical switching apparatus as defined in claim 1, further comprising a leaf spring (43) for positioning the armature (42) and rivet pins (40) attaching the leaf spring (43) to the side pieces (30*a*) and to the armature, so that the armature (42) is attached to the magnetic angle piece by means of the leaf spring.

3. The electrical switching device as defined in claim 1, and consisting of an electrical relay.

4. An electrical switching apparatus comprising:

a housing (10);

a coil (20) arranged in the housing (10);

at least two switch terminals (35,50,60) arranged in the housing (10);

a magnetic angle piece (30) arranged in the housing (10) and including two side pieces (30*a*), one (35) of said at least two switch terminals (35,50,60) connected to the two side pieces (30*a*) at one end of the magnetic angle piece, an upper portion (31) of the magnetic angle piece extending at substantially right angles to the two side pieces (30*a*) and connecting the side pieces (30*a*) at another end of the magnetic angle piece opposite from the one end and a core (32) for the coil (20), the core (32) extending at substantially right angles to the side pieces (30*a*) between the two side pieces (30*a*), wherein said upper portion (31), said two sides pieces (30*a*), said core (32) and said one (35) of said at least two switch terminals (35,50,60) are all in one piece in said magnetic angle piece; and an armature (42) resiliently mounted on the magnetic angle piece (30) for making electrical contact between said one (35) of at least two switch terminals (35,50,60) and another of said at least two switch terminals (35,50,60);

wherein said magnetic angle piece is made by a method comprising the steps of:

a) punching or stamping a substantially rectangular punched or stamped piece (39) from sheet metal including the one (35) of the at least two switch terminals (35, 50, 60) at the one end thereof in one piece with the punched or stamped piece (39);

b) providing a U-shaped opening (38) for formation of a separately bendable tongue (32*a*) in a central region of the substantially rectangular punched or stamped piece (39) so that said side pieces (30*a*) are located on opposite sides of the U-shaped opening (38) and a connecting piece (31*a*) connects the side pieces (30*a*) on another end of the punched or stamped piece (39) opposite from said one (35) of said at least two switch terminals;

c) bending the separately bendable tongue (32*a*) at substantially right angles to a remaining portion of the substantially rectangular punched or stamped piece (39) including the side pieces (30*a*) to form the core (32) of the coil (20); and d) bending the rectangular connecting piece (31*a*) at substantially right angles to the remaining portion of the substantially rectangular punched or stamped piece (39) including the side pieces (30*a*) to form the upper portion (31) of the magnetic angle piece arranged substantially parallel to the core (32).

5. The electrical switching apparatus as define in claim 4, wherein said method of making the magnetic angle piece includes cutting the separately bendable tongue (32*a*) in the punched or stamped piece (39) and forming the core (32) immediately after the cutting by subsequently bending the tongue (32*a*).

6. The electrical switching apparatus as define in claim 4, wherein said method of making the magnetic angle piece includes performing said bending and said providing said U-shaped opening so that a space or distance between the upper portion (31) and the core (32) arises that is substantially equal to half a diameter of said coil (20).

7. A substantially rectangular punched or stamped piece for making a magnetic angle piece (30) which is part of an electrical switching device;

wherein said electrical switching device comprises a housing (10), a coil (20) arranged in the housing (10), at least two switch terminals (35,50,60) arranged in the housing (10), the magnetic angle piece (30) arranged in the housing (10) and including two side pieces (30*a*), one (35) of said at least two switch terminals (35,50,60) connected to the two side pieces (30*a*) at one end of the magnetic angle piece, an upper portion (31) of the magnetic angle piece extending at substantially right angles to the two side pieces (30*a*) and connecting the side pieces (30*a*) at another end of the magnetic angle piece opposite from the one end and a core (32) for the coil (20), said core (32) extending at substantially right angles to the side pieces (30*a*) between the two side pieces (30*a*), wherein said upper portion (31), said two sides pieces (30*a*), said core (32) and said one (35) of said at least two switch terminals (35,50,60) are all in one piece in said magnetic angle piece and an armature (42) resiliently mounted on the magnetic angle piece (30) for making electrical contact between said one (35) of at least two switch terminals (35,50,60) and another of said at least two switch terminals (35,50,60);

wherein said substantially rectangular punched or stamped piece (39) is provided with a central substantially U-shaped opening (38) and includes said one (35) of said at least two switch terminals at one end thereof, a separately bendable tongue (32*a*) bordered or adjoining the U-shaped opening and bendable to form the core (32), the side pieces (30*a*) on opposite sides of the U-shaped opening (38) and a bendable rectangular connecting piece (31*a*) connecting the side pieces (30*a*) at another end opposite from the one end having the one (35) of the at least two switch terminals, said connecting piece (31*a*) being bendable to form the upper portion (31) of said magnetic angle piece (30) so that the upper portion (31) is substantially parallel with said core (32).

* * * * *